US007310066B1

(12) United States Patent
Li

(10) Patent No.: US 7,310,066 B1
(45) Date of Patent: Dec. 18, 2007

(54) DUAL POLARIZED ANTENNA

(75) Inventor: Nan Lin Li, 7F, No. 276, Sec. 1, Datong Rd., Sijhih City, Taipei County (TW)

(73) Assignees: Wieson Technologies Co., Ltd., Sijhih (TW); Nan Lin Li, Sijhih (TW)

( * ) Notice: Subject to any disclaimer, the term of this patent is extended or adjusted under 35 U.S.C. 154(b) by 0 days.

(21) Appl. No.: 11/544,860

(22) Filed: Oct. 10, 2006

(30) Foreign Application Priority Data

Sep. 1, 2006 (TW) ..... 95132437 A

(51) Int. Cl.
*H01Q 1/38* (2006.01)

(52) U.S. Cl. ..... 343/700 MS; 343/853

(58) Field of Classification Search ..... 343/700 MS, 343/853, 846
See application file for complete search history.

(56) References Cited

U.S. PATENT DOCUMENTS 5,534,877 A * 7/1996 Sorbello et al. ..... 343/700 MS
5,661,493 A * 8/1997 Uher et al. ..... 343/700 MS
6,529,170 B1 * 3/2003 Nishizawa et al. ..... 343/795

* cited by examiner

*Primary Examiner*—Hoang V. Nguyen
(74) *Attorney, Agent, or Firm*—Birch, Stewart, Kolasch & Birch, LLP

(57) ABSTRACT

The present invention relates to dual polarized antenna which is capable of simultaneously radiating electromagnetic waves in horizontal as well as vertical polarization directions for the broadest electromagnetic-wave coverage and forming an omnidirectional electromagnetic field.

4 Claims, 5 Drawing Sheets

DUAL POLARIZED ANTENNA

BACKGROUND OF THE INVENTION

1. Technical Field

The present invention relates to a dual polarized antenna and, more particularly, to a versatile antenna system capable of receiving vertical signals and horizontal signals simultaneously.

2. Description of Related Art

So-called MIMO (Multiple Input Multiple Output) involves receiving or transmitting wireless network signals by means of multiple antennas and channels with enhanced transmission efficiency. Such a MIMO system is typically equipped with plural (mostly three) sets of antennas at both the transmitter and the receiver thereof for overcoming the problem of the reduced transmission efficiency during receiving or transmitting. More particularly, MIMO technology segments digital data multiply and implements multiple antennas to enhance data transmission efficiency when receiving or transmitting the processed signals simultaneously.

Since MIMO technology segments digital data and transmits the same through multipath transmission, it facilitates relaxing single-way signal flow and extending the transmission distance as well as the reception range of antennas. Hence, MIMO is generally applied to current wireless network apparatuses where high speed and long distance of transmission are desired.

As a contemporary wireless router product with MIMO technology typically comprises three sets of half wave antennas, which are aligned in to a row or a triangle with a particular interval mutually, however, those antennas can only be arranged manually to an alternative polarization direction. For instance, when a vertical polarization direction of an antenna is demanded, the antenna has to be settled vertically to the horizontal; and when a horizontal polarization direction is needed, it has to parallel to the horizontal. Thus, each antenna can only achieve single polarization. This may in turn incur receiving dead points and causes the antenna to be disadvantageously inflexible between transmitting and receiving functions according to the surrounding signal strength.

On the other hand, a Smart Antenna, according to the surrounding signal strength, allows an antenna performing optimal reception to be switched to act as the receiver. Such a system generally comprises two sets of half wave antennas and a switch that is provided for each antenna to couple with the signal transmitter/receiver. When there are signals to be transmitted, both the antennas are implemented simultaneously (both the antennas work as transmitters). Alternatively, when there are signals to be received, the system first compares the received noise levels of both antennas to find the one that is receiving signals stronger and picks it as the receiver through the switch for optimum wireless signal transmission and reception.

Accordingly, a need exists for an antenna that integrates the advantages of the discussed MIMO technology and a Smart Antenna.

SUMMARY OF THE INVENTION

The present invention has been accomplished under the circumstances in view. It is one object of the present invention to provide a dual polarized antenna, which comprises plural horizontal polarized modules and vertical polarized modules to achieve synchronous receiving of the horizontal and vertical signals that correspond to the modules. Thereby, receiving dead points that occur with single polarized antennas can be eliminated and omnidirectional signal reception can be fulfilled.

It is another object of the present invention to provide a dual polarized antenna, which is capable of simultaneously radiating electromagnetic waves in horizontal as well as vertical polarization directions for the broadest electromagnetic-wave coverage and forming an omnidirectional electromagnetic field.

To achieve these and other objects of the present invention, the dual polarized antenna comprises:

a substrate;

a negative potential dual frequency radiating assembly disposed on the first surface of the substrate, which includes:

a negative potential common signal coupler, and a plurality of negative potential dual frequency radiating units connected respectively to the signal coupler, wherein, each negative potential dual frequency radiating unit contains a negative potential high frequency radiating component and a negative potential low frequency radiating component, and wherein, each radiating component has a horizontal segment and a vertical segment;

a positive potential dual frequency radiating assembly disposed on the second surface of the substrate, which includes:

a plurality of positive potential feeders, and a plurality of positive potential dual frequency radiating units connected respectively to the feeders, wherein, each positive potential dual frequency radiating unit contains a positive potential high frequency radiating component and a positive potential low frequency radiating component, and wherein, each radiating component has a horizontal segment and a vertical segment; and wherein, each horizontal segment of the negative potential high frequency radiating components and negative potential low frequency radiating components is connected to the corresponding horizontal segment of the positive potential high frequency radiating components and positive potential low frequency radiating components thereof to form a horizontal polarized module; while each vertical segment of the negative potential high frequency radiating components and negative potential low frequency radiating components is connected to the corresponding vertical segment of the positive potential high frequency radiating components and positive potential low frequency radiating components thereof to form a vertical polarized module.

According to the present invention, when the disclosed dual polarized antenna is implemented to radiate the signals generated by a system, the negative potential signals are transmitted to the negative potential dual frequency radiating units via the negative potential common signal coupler and broadcasted into the atmosphere in the horizontal polarization direction, and the positive potential signals corresponding to the negative potential signals are transmitted to the positive potential dual frequency radiating units by the characteristic impedance matching of the positive potential feeders and broadcasted into the atmosphere in the vertical polarization direction. Thereupon, electromagnetic signals can be simultaneously radiated in horizontal as well as vertical polarization directions into the atmosphere and therefore an omnidirectional electromagnetic field is shaped.

When the disclosed dual polarized smart antenna is implemented for signal reception, the positive and negative electromagnetic signals are received respectively by the positive potential dual frequency radiating units of the vertical polarized module and negative potential dual frequency radiating units of the horizontal polarized module. Then the received signals are converged and transmitted to the system for further processing via the positive potential feeders. By the disclosed structure, the dual polarized antenna facilitates reducing the receiving of dead points and achieving omni-directional signal reception.

Further, the disclosed dual polarized smart antenna may include plural electromagnetic wave isolating units. Each isolating unit is arranged between two adjacent said horizontal polarized modules on the substrate to preclude interference among the modules so that the interval between the two modules can be significantly reduced.

Moreover, the disclosed dual polarized smart antenna may have a switch between the two positive potential feeders. Thereby, the system can designate the positive potential dual frequency radiating unit performing optimum reception that is determined by comparing the received signal strength of the positive potential dual frequency radiating units over the substrate.

DETAILED DESCRIPTION OF THE PREFERRED EMBODIMENT

The invention as well as a preferred mode of use, further objectives and advantages thereof, will best be understood by reference to the following detailed description of an illustrative embodiment when read in conjunction with the accompanying drawings.

Figure 1:
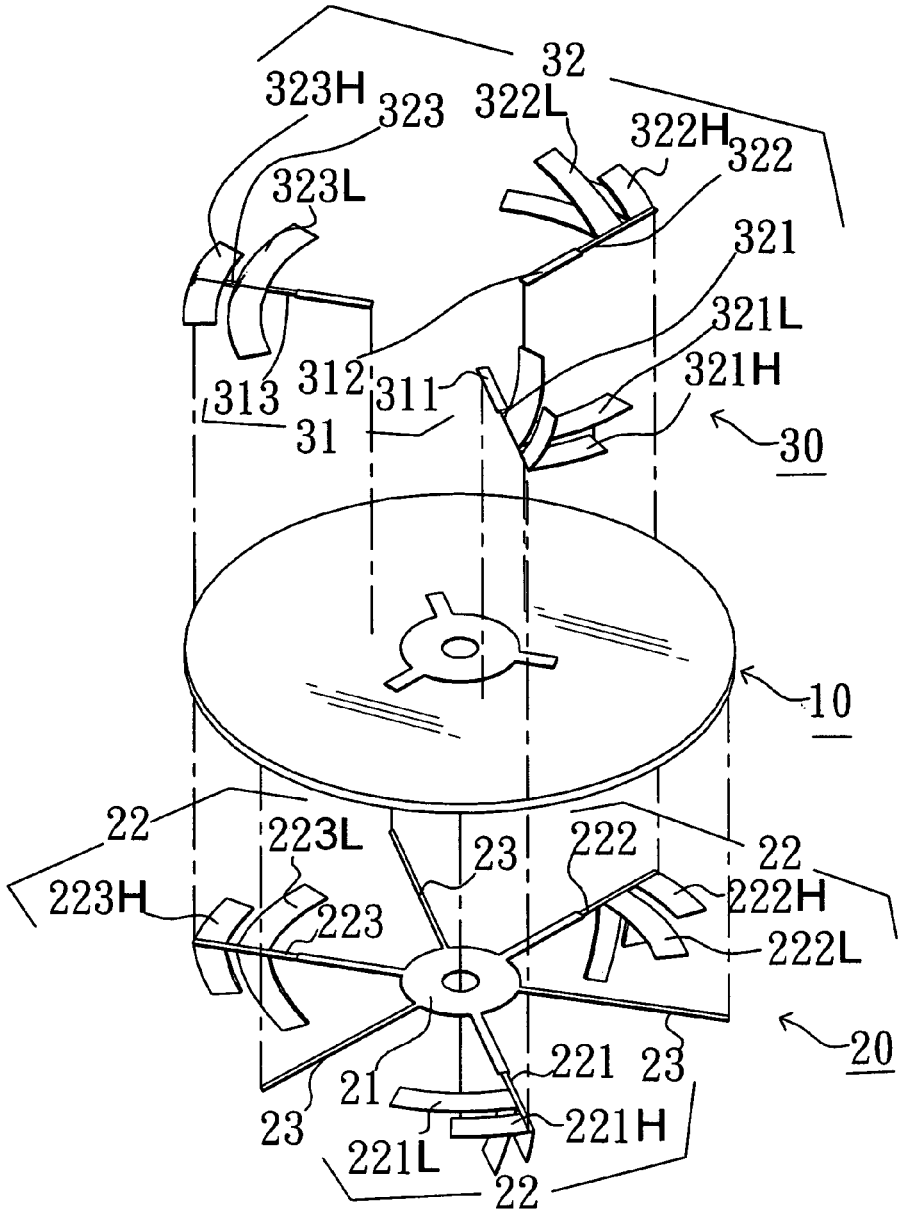
FIG. 1 is an exploded view of the dual polarized antenna according to the present invention.
Figure 2:
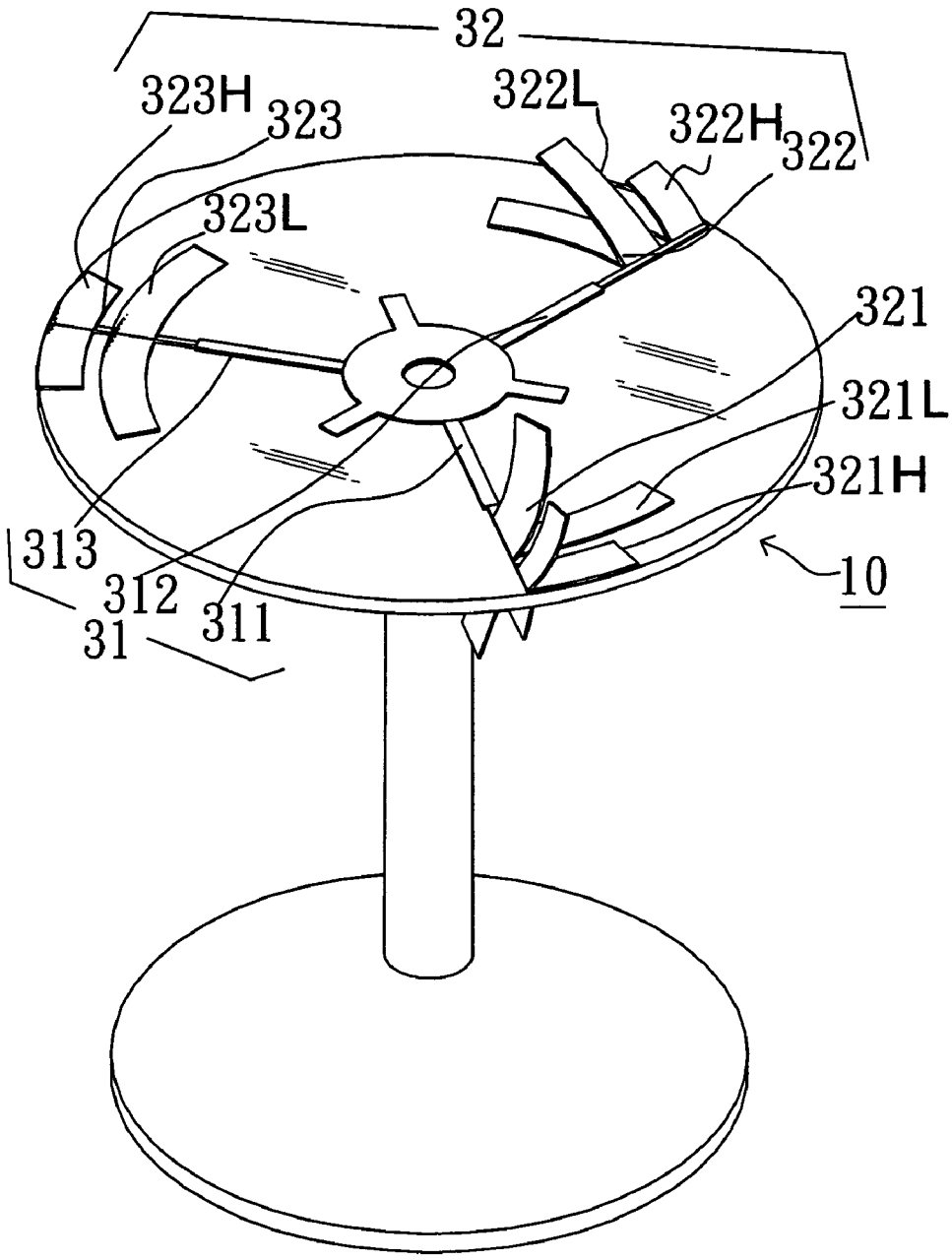
FIG. 2 is a perspective view of the dual polarized antenna according to the present invention.
Figure 3:
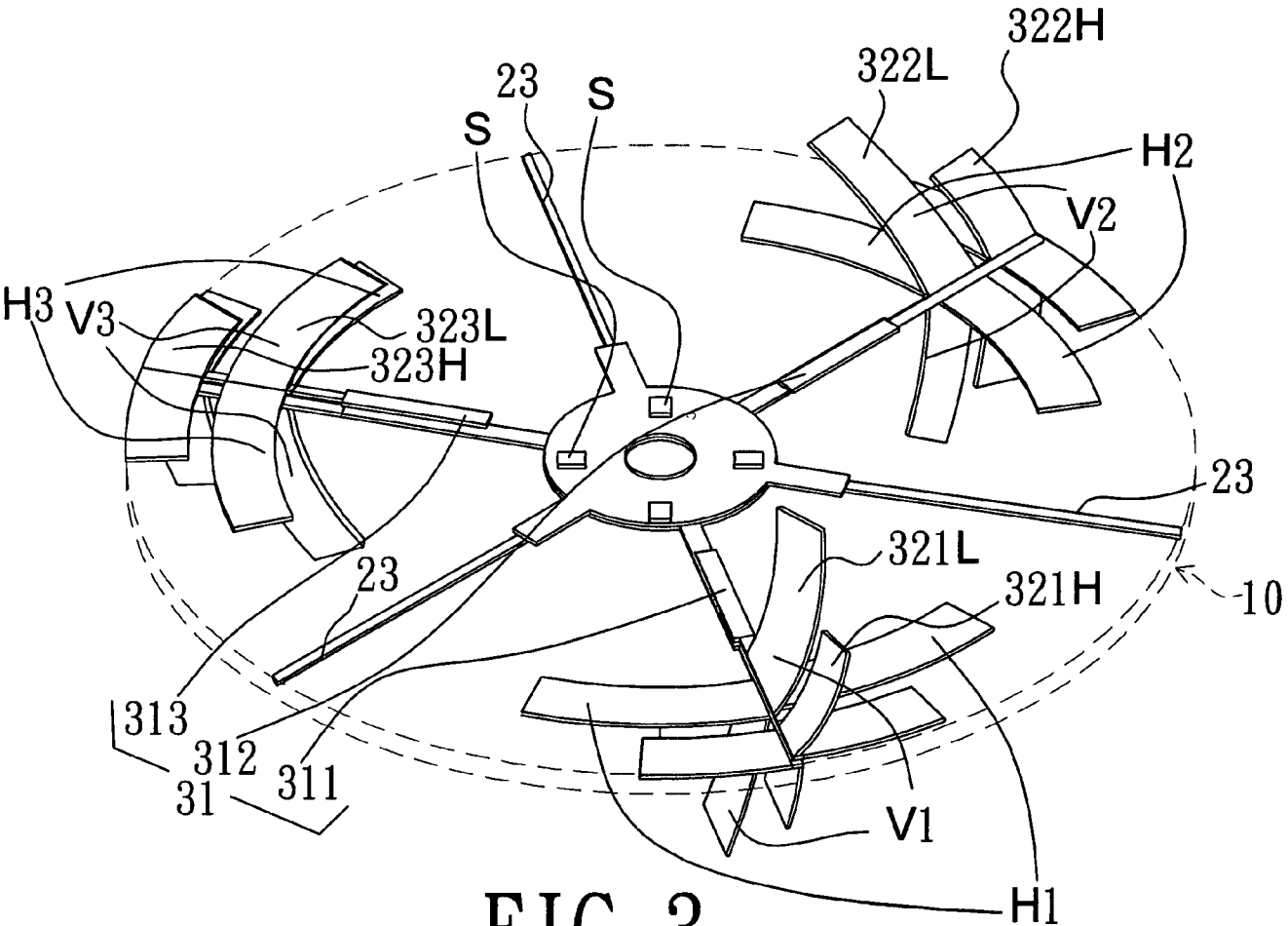
FIG. 3 is a schematic drawing showing the horizontal polarized modules and vertical polarized modules of the dual polarized antenna according to the present invention.

As to FIGS. 1 to 3, FIG. 1 is an exploded view of the dual polarized antenna according to the present invention; FIG. 2 is a perspective view of the dual polarized antenna according to the present invention; and FIG. 3 is a schematic drawing showing the horizontal polarized modules and vertical polarized modules of the dual polarized antenna according to the present invention.

As shown in the figures, the present invention is to provide a dual polarized antenna comprising at least: a substrate 10, a negative potential dual frequency radiating assembly 20 and a positive potential dual frequency radiating assembly 30, wherein the negative potential dual frequency radiating assembly 20 is disposed on a first surface of the substrate 10 while the positive potential dual frequency radiating assembly 30 is disposed on a second surface of the substrate 10.

Further, the substrate 10 can be formed as a round plate made from fiberglass or ceramics to accommodate the negative and positive potential dual frequency radiating assemblies 20, 30 on the first and second surfaces of the substrate 10 thereof.

Moreover, the negative potential dual frequency radiating assembly 20 arranged on the first surface of the substrate 10 comprises at least: a negative potential common signal coupler 21 and a plurality of negative potential dual frequency radiating units 22 connected respectively to the signal coupler 21, wherein, each negative potential dual frequency radiating unit 22 contains a negative potential high frequency radiating component 221 and a negative potential low frequency radiating component 222, and wherein, each radiating component has a horizontal segment lain on the surface of the substrate 10 and a vertical segment perpendicular to the surface of the substrate 10. In the discussed embodiment, three negative potential dual frequency radiating units are provided as a first negative potential dual frequency radiating unit 221, a second negative potential dual frequency radiating unit 222 and a third negative potential dual frequency radiating unit 223 which are respectively connected to the negative potential common signal coupler 21; and the first, second and third negative potential high frequency radiating components 221H, 222H, 223H as well as the first, second and third negative potential low frequency radiating components 221L, 222L, 223L of the first, second and third negative potential dual frequency radiating units 221, 222, 223, and wherein, each has a horizontal segment and a vertical segment.

Further, the positive potential dual frequency radiating assembly 30 arranged on the second surface of the substrate 10 comprises at least: a plurality of positive potential feeders 31, and a plurality of positive potential dual frequency radiating units 32, wherein, the positive potential feeders 31 contain a first positive potential feeder 311, a second positive potential feeder 312 and a third positive potential feeder 313; and the positive potential dual frequency radiating units 32 include a first positive potential dual frequency radiating unit 321, a second positive potential dual frequency radiating unit 322 and a third positive potential dual frequency radiating unit 323; and wherein, the first positive potential feeder 311, second positive potential feeder 312 and third positive potential feeder 313 are connected respectively to the first positive potential dual frequency radiating unit 321, second positive potential dual frequency radiating unit 322 and third positive potential dual frequency radiating unit 323. Additionally, the positive potential dual frequency radiating units 321, 322, 323 have respectively positive potential high frequency radiating components 321H, 322H, 323H and positive potential low frequency radiating components 321L, 322L, 323L, and wherein each radiating component has a horizontal segment and a vertical segment. Thereby, the horizontal segment of the first positive potential dual frequency radiating unit 321 is connected to the horizontal segment of the first negative potential dual frequency radiating unit 221 to form a first horizontal polarized module H1. Meanwhile, the vertical segment of the first positive potential dual frequency radiating unit 321 is connected to the vertical segment of the first negative potential dual frequency radiating unit 221 to form a first vertical polarized module V1. Similarly, the horizontal segments of the second and third positive potential dual frequency radiating units 322, 323 are connected to the horizontal segments of the second and third negative potential dual frequency radiating units 222, 223 to form a second horizontal polarized module H2 and third horizontal polarized module H3. And the vertical segments of the second and third positive potential dual frequency radiating units 322, 323 are connected to the vertical segments of the second and third negative potential dual frequency radiating units 222, 223 to form a second vertical polarized module V2 and third vertical polarized module V3 (as shown in FIG. 3).

Figure 4:
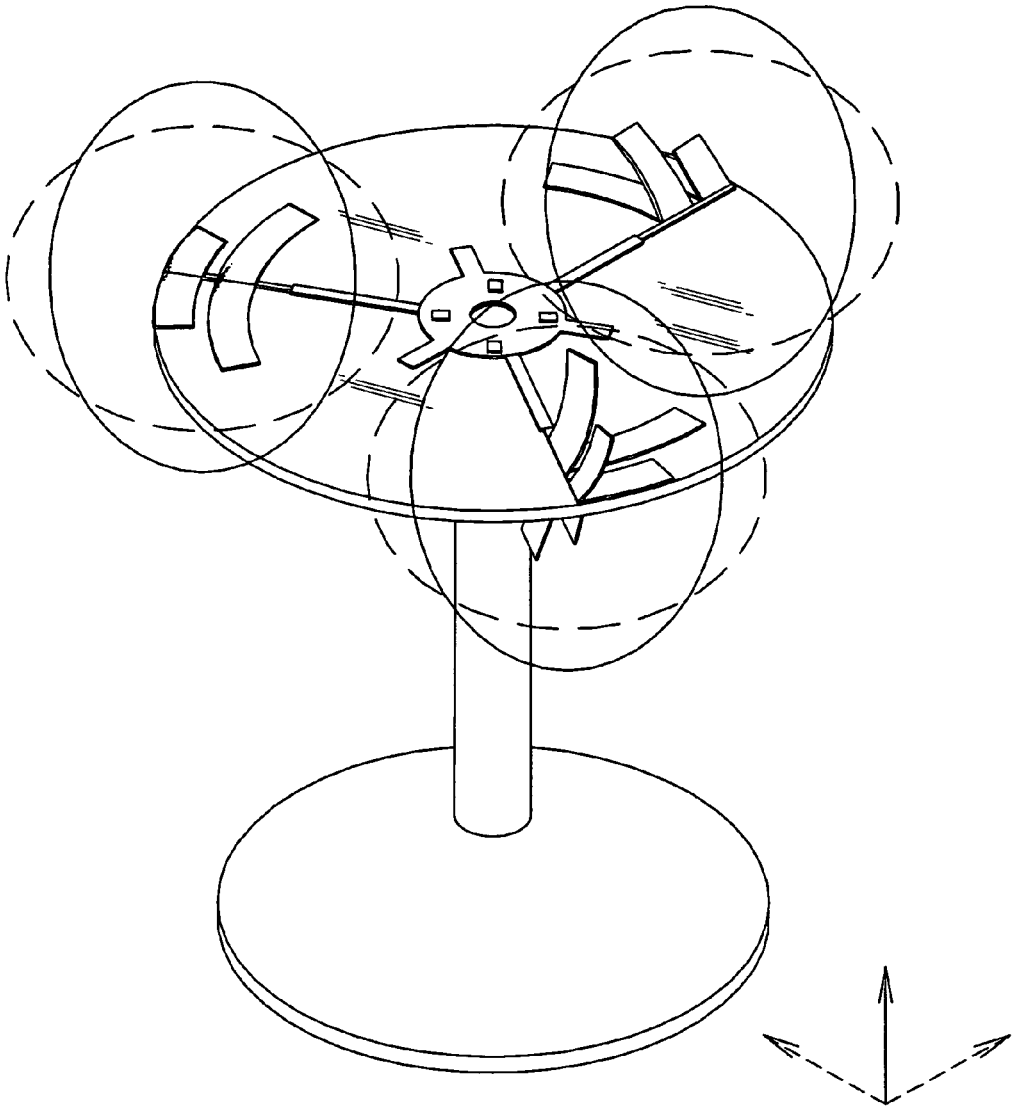
FIG. 4 is a schematic drawing illustrating the radiation of the horizontal polarized modules and vertical polarized modules of the dual polarized antenna according to the present invention.
Figure 5:
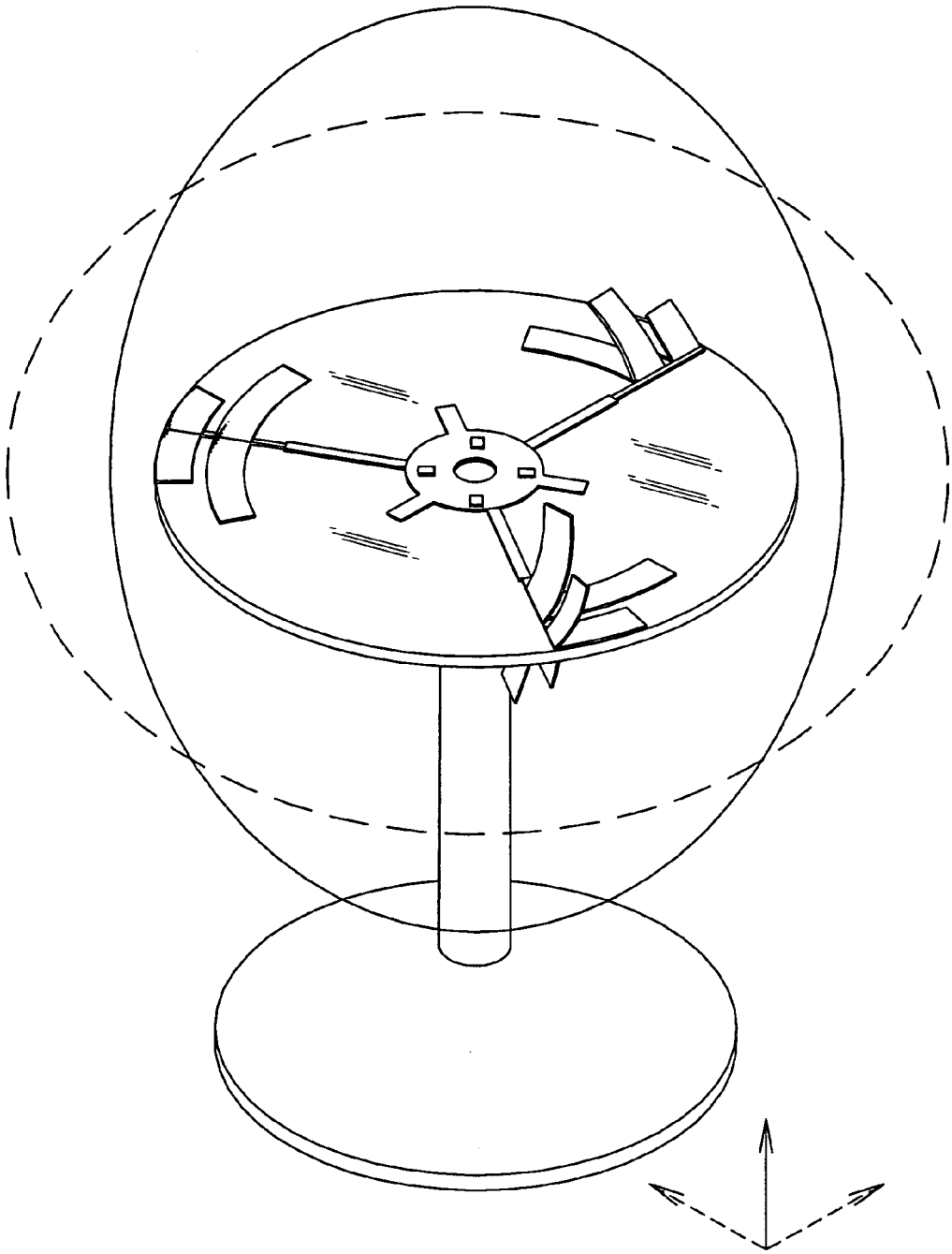
FIG. 5 is a schematic drawing illustrating the horizontal radiation and vertical radiation of the dual polarized antenna according to the present invention.

Now referring to FIGS. 1, 4 and 5, FIG. 4 is a schematic drawing illustrating the radiation of the horizontal polarized modules and vertical polarized modules of the dual polarized antenna according to the present invention; and FIG. 5 is a schematic drawing illustrating the horizontal radiation and vertical radiation of the dual polarized antenna according to the present invention.

When the disclosed dual polarized antenna is implemented to radiate the signals generated by a system, the negative potential signals are transmitted to the negative potential dual frequency radiating units 221, 222, 223 via the negative potential common signal coupler 21 and broadcasted into the atmosphere in the horizontal polarization direction, and the positive potential signals corresponding to the negative potential signals are transmitted to the positive potential dual frequency radiating units 321, 322, 323 by the characteristic impedance matching of the positive potential feeders 311, 312, 313 and broadcasted into the atmosphere in the vertical polarization direction. Thereupon, electromagnetic signals can be simultaneously radiated in horizontal as well as vertical polarization directions into the atmosphere and therefore an omnidirectional electromagnetic field is shaped (as shown in FIGS. 4 and 5).

As the disclosed dual polarized smart antenna is implemented to receive signals, the positive and negative electromagnetic signals are received respectively by the positive potential dual frequency radiating units 32 of the vertical polarized module and negative potential dual frequency radiating units 22 of the horizontal polarized module. Then the received signals are converged and transmitted to the system for further processing via the positive potential feeders 31 to achieve omnidirectional signal reception.

Referring back to FIG. 3, the disclosed subject matter further includes electronic switches S to designate the first positive potential dual frequency radiating unit 321, the second positive potential dual frequency radiating unit 322 and third positive potential dual frequency radiating unit 323 as either transmitters or receivers. More particularly, the electronic switches S are preprogrammed with the corresponding potential difference of the radiating units and the system compares and computes the signals received by the dual frequency radiating units to determine the one performing optimum reception. Afterward, the system modifies the D.C. output potential thereof in accordance with the preset potential difference to direct the electronic switches S to communicate with the designated radiating unit to act as a receiver for vertical and horizontal signals while the others act as transmitters.

Now referring back to FIG. 1 again, some electromagnetic wave isolating units 23 are arranged among the horizontal polarized modules H1, H2, H3 on the substrate to preclude the interference among the modules so that the interval between the two modules can be significantly reduced. Thereupon, the volume of the disclosed dual polarized antenna can be eventually reduced.

Although a particular embodiment of the invention has been described in detail for purposes of illustration, it will be understood by one of ordinary skill in the art that numerous variations will be possible to the disclosed embodiments without going outside the scope of the invention as disclosed in the claims.

What is claimed is:

1. A dual polarized antenna comprising:

a substrate;

a negative potential dual frequency radiating assembly disposed on a first surface of the substrate, which includes:

a negative potential common signal coupler, and a plurality of negative potential dual frequency radiating units connected respectively to the signal coupler, wherein, each negative potential dual frequency radiating unit contains a negative potential high frequency radiating component and a negative potential low frequency radiating component, and wherein, each radiating component has a horizontal segment and a vertical segment;

a positive potential dual frequency radiating assembly disposed on a second surface of the substrate, which includes:

a plurality of positive potential feeders, and a plurality of positive potential dual frequency radiating units connected respectively to the feeders, wherein, each positive potential dual frequency radiating unit contains a positive potential high frequency radiating component and a positive potential low frequency radiating component, and wherein, each radiating component has a horizontal segment and a vertical segment; and thereby, each horizontal segment of the negative potential high frequency radiating components and negative potential low frequency radiating components is connected to the corresponding horizontal segment of the positive potential high frequency radiating components and positive potential low frequency radiating components thereof to form a horizontal polarized module while each vertical segment of the negative potential high frequency radiating components and negative potential low frequency radiating components is connected to the corresponding vertical segment of the positive potential high frequency radiating components and positive potential low frequency radiating components thereof to form a vertical polarized module.

2. The dual polarized antenna as claimed in claim 1, wherein an electromagnetic wave isolating unit is arranged between the two adjacent said horizontal polarized modules on the substrate.

3. The dual polarized antenna as claimed in claim 1, wherein the negative potential dual frequency radiating units are disposed on the positions corresponding to the positions of the positive potential dual frequency radiating units, respectively.

4. The dual polarized antenna as claimed in claim 1, wherein each said horizontal polarized module corresponds to each said vertical polarized module.

* * * * *